United States Patent [19]

Tanaka et al.

[11] Patent Number: 4,710,443

[45] Date of Patent: Dec. 1, 1987

[54] TONER, CHARGE-IMPARTING MATERIAL AND COMPOSITION CONTAINING TRIAZINE TYPE COMPOUND

[75] Inventors: Katsuhiko Tanaka, Tokyo; Hiroshi Fukumoto, Kawasaki, both of Japan

[73] Assignee: Canon Kabushiki Kaisha, Tokyo, Japan

[21] Appl. No.: 840,854

[22] Filed: Mar. 18, 1986

[30] Foreign Application Priority Data

Mar. 19, 1985 [JP] Japan ..... 60-53352
May 13, 1985 [JP] Japan ..... 60-100925

[51] Int. Cl.[4] ..... G03G 9/14
[52] U.S. Cl. ..... 430/106.6; 430/110
[58] Field of Search ..... 430/110, 105, 106.6

[56] References Cited

U.S. PATENT DOCUMENTS 4,085,057 4/1978 Masuda et al. ..... 430/110
4,554,233 11/1985 Hashimoto et al. ..... 430/110

*Primary Examiner*—John L. Goodrow

*Attorney, Agent, or Firm*—Fitzpatrick, Cella, Harper & Scinto

[57] ABSTRACT

A triboelectrically chargeable composition for use in development of electrostatic latent images. The composition contains triazine type compound represented by the formula:

wherein $R_1$, $R_2$ and $R_3$ are the same or different groups selected from hydrogen atom and electron-donating groups which are more electron-donative than hydrogen atom, all of $R_1$, $R_2$ and $R_3$ not being hydrogen atom. The composition is embodied typically as a positively chargeable toner and also as a charge-imparting material for charging a toner.

16 Claims, 1 Drawing Figure

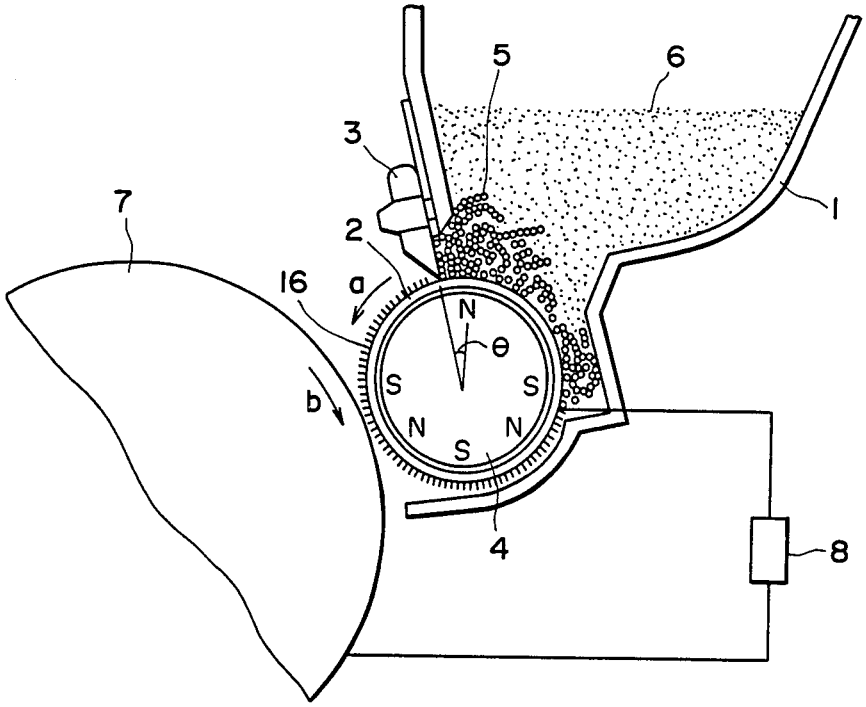
5
6
3
7
1
2
16
a
N
θ
S
S
b
N
N
S
4
8

TONER, CHARGE-IMPARTING MATERIAL AND COMPOSITION CONTAINING TRIAZINE TYPE COMPOUND

FIELD OF THE INVENTION AND RELATED ART

The present invention relates to a toner used in a developer for developing electrostatic images in electrophotography, electostatic recording and electrostatic printing, more particularly to a toner for developing electrostatically charged images containing a triazine type compound, which is uniformly and strongly charged positively to visualize negatively charged electrostatic image or visualize positively charged electrostatic image through reversal development, thereby providing high-quality images.

Further, the present invention relates to an electric charge-imparting material for imparting triboelectric charge to a developer containing a triazine type compound for developing electrostatic images in electrophotography, electrostatic recording and electrostatic printing.

Furthermore, the present invention relates to a triboelectrically chargeable composition containing a triazine type compound for use in development of electrostatic images to form a visible image in electrophotography, electrostatic recording and electrostatic printing.

Hitherto, a large number of electrophotographic processes have been known, as disclosed in U.S. Pat. Nos. 2,297,691; 4,071,361, and others. Generally speaking, photoconductive materials are utilized in these processes, and the steps included therein comprise forming electrical latent images on photosensitive members by various means, then developing the latent images by using developing powder (frequently called as "toner"), transferring the toner images thus formed to a recording medium such as paper, as desired, and thereafter fixing the images by heating, pressure or solvent vapor to obtain copies. When the step of transferring the toner images is adopted, it is a general practice to provide a step for removing residual toner on the photosensitive member.

The developing methods for visualizing electrical latent images by use of toners known in the art may include, for example, the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; and the method using conductive magnetic toner as disclosed in U.S. Pat. No. 3,909,258.

As the toner for dry development system to be applied for these developing methods, fine powder of natural or synthetic resins having dyes or pigments dispersed therein has heretofore generally been used. For example, a colorant is dispersed in a binder resin such as polystyrene, and the particles obtained by micropulverizing the resultant dispersion into sizes of about 1 to 30 microns are used as the toner. As the magnetic toner, magnetic particles are further incorporated into the particles as mentioned above. In case of the system employing the two-component developer, the toner as mentioned above is used generally in mixture with carrier particles such as glass beads and iron particles.

For such a toner for dry-system development, it has been becoming a general practice to use a positive or negative charge controlling agent in order to improve the charging characteristic.

Positive charge controllers conventionally used in toners for dry development system, may include, for example, quaternary ammonium compounds and organic dyes, particularly basic dyes and salts thereof including nigrosine base and nigrosin. These charge controllers are usually added to a thermoplastic resin to be dispersed in the resin while it is molten under heating, and the resultant resin mixture is micropulverized into fine particles and, if desired, adjusted to suitable sizes. The conventional charge controllers have been composed of such coarse particles that 30 % by number or less thereof have particle sizes which are 1/5 or smaller of the average particle size of the toner to be used in combination.

However, these conventional charge controllers are liable to cause lowering in the charge controlling characteristic, when subjected to mechanical collision and friction during kneading under heat to change in temperature and humidity conditions.

Accordingly, when a toner containing these charge controllers is used in a copying machine to effect development, the toner can cause deterioration during continual use.

Further, these conventional charge controllers, as represented by nigrosine, show dense colors which provide a serious obstacle to formation of toners in bright chromatic colors.

As another serious disadvantage, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controllers more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner carrying member and also cause lowering in free flowing properly of the toner, fog and lowering in image density. Alternatively, for improvement in dispersibility of these dyes into a resin, there is also employed a method in which powder of a charge controller and resin powder are previously mechanically pulverized and mixed before fusion kneading. This method is not competent enough to overcome the original poor dispersibility, and evenness of charging satisfactory in practical application has not yet been obtained.

More specifically, when such a conventional charge controller is used in a toner, uneven or different amounts of charge are provided to individual toner particles through friction between toner particles, toner and carrier particles, or toner and a toner-carrying member such as a sleeve, whereby an undesirable phenomenon such as developing fog, toner scattering or carrier contamination is liable to occur. Such an undesirable phenomenon is pronounced when copying is repeated for a large number of times, thereby to render the toner substantially unsuitable for copying. Further a toner thus obtained has a remarkably lower transfer efficiency under a high humidity condition and is thus unfit for a practical use.

Furthermore, when such a toner containing a conventional charge controller is used for a long time, sticking of toner is promoted due to insufficient charge to result in an undesirable influence to formation of latent images (filming), or an ill effect to a cleaning step in copying operation such as formation of flaws on a photosensitive member or a cleaning member such as a cleaning blade or promotion of wearing of these members.

Thus, the use of conventional large controllers involves many problems, the dissolution of which is earnestly expected in this technical field. While there have been many proposals for improvement, a charge controller satisfying practical requisites as a whole has not been obtained.

In order to have a toner acquire an electric charge, a method of utilizing only the triboelectric chargeability of the toner per se has been known as described above. In this method, however, the chargeability of the toner is small unless it contains an appropriate charge controller, the image obtained by such a toner is liable to be accompanied with fog and unclear. For this reason, there has been proposed to impart triboelectric charge by a movement or carriage-regulating member such as magnetic particles, a carrier, a sleeve or a doctor blade, or a developing material or member for charging. The developing material or member for charging is a material or member for imparting or auxiliarily imparting a triboelectric charge to a toner through contact with the toner.

If such a charge-imparting material having a charge imparting ability is used, the amount of an additive for controlling the chargeability of a toner, i.e., a charge controller, contained in the toner is minimized, whereby contamination of a carrier or a photosensitive member with the additive is minimized. Therefore, lowering of chargeability or disturbance of latent images during a successive copying operation is minimized, so that even a color toner can readily be charged.

However, in order to provide a good charge-imparting property to a movement-regulating material such as magnetic particles, a carrier, sleeve or doctor blade, or a developing member for charging, it is necessary to use a substance or compound which can provide a strong charge-imparting ability and also can be applied or coated onto the material or can be dispersed in the material. In this regard, the carrier particles are generally used for a long period of time without exchange, and the sleeve is used until the main body of a copier cannot be used, so that they must be mechanically tough and durable for a long period of time. Thus, a good additive for improving a charge-imparting characteristic of such a charge imparting for supplementing the chargeability of toner is also expected.

SUMMARY OF THE INVENTION

A principal object of the present invention is to provide a new technique for dissolving the above mentioned problems in the field of controlling electric charge of a toner.

A specific object of the present invention is to provide a positively chargeable toner or a developer containing the toner.

Another object of the present invention is to provide a developer which can be provided with a stable amount of and a sharp and uniform distribution of triboelectric charge through friction between toner particles, between toner and carrier or between toner and a toner-carrying member such as a sleeve in case of one-component development system and can be controlled to have a triboelectric charge in an amount adapted to a developing system to be used.

A still further object of the invention is to provide a developer capable of effecting development and transfer faithful to latent images, i.e., a developer capable of realizing a high image density and a good reproducibility of a half tone without causing sticking of the toner to a background region, fog or scattering of the toner in the neighborhood of latent image contour during development.

A further object of the invenion is to provide a developer which retains initial performances without causing agglomeration or change in charging characteristic of the toner even when the developer is continually used for a long time.

A still another object of the invention is to provide a toner which reproduces a stable image not readily be affected by change in temperature and humidity, particularly a developer having a high transfer efficiency without causing scattering or transfer drop-off during transferring under a high humidity or a low humidity.

A further object of the invention is to provide a developer with excellent storage stability which can retain initial characteristics even after a long period of storage.

A further object of the invention is to provide a bright chromatic developer.

A still further object of the invention is to provide a developer which facilitates a cleaning step without staining, abrading or flawing an electrostatic latent image-bearing surface.

Another object of the invention is to provide a developer with a good fixation characteristic, particularly a developer with no problem in respect of high-temperature offset.

A still further object of the present invention is to provide a charge-imparting material or member improved in charge-imparting capability for imparting an appropriate amount of negative charge to a toner.

A further object of the invention is to provide an improved charge-imparting material which is less liable to deteriorate in its performance during a long period of use.

A still further object of the invention is to provide a charge-imparting material or member adapted to a chromatic toner.

A generic object of the present invention is to provide of a triboelectrically chargeable composition inclusive of a toner for developing electrostatic images and a charge-imparting material or member with characteristics as described above.

According to a principal aspect of the present invention, there is provided a positively chargeable toner for developing electrostatic images comprising a binder, a colorant and a triazine type compound represented by the following formula:

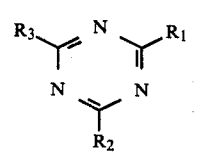

wherein $R_1$, $R_2$ and $R_3$ are respectively a hydrogen atom or an electron-donating group and may be the same or different.

According to another aspect of the present invention, there is provided a charge-imparting material comprising a triazine type compound as described above, and a base material carrying the compound. Herein, the term "charge-imparting material" is intended to cover materials having a function of imparting triboelectric charge to a toner, which are in the form of particles such as magnetic particles or carrier particles used in combination with a toner to form a two-component developer or a solid member such as a doctor blade, a toner-carrying member such as a sleeve, and other members which contact a toner before or during a developing step. The term "carrying" has been used to cover the cases where the triazine type compound is dispersed in the base material which may be in the form of particles or a solid member as described above, or carried as a coating on the surface or an embedded substance in the surface layer of the base material.

According to a broader and generic aspect of the present invention, there is provided a triboelectricallly chargeable composition comprising the above mentioned triazine type compound and a base material carrying the compound. Herein, the term "composition" has been used to cover the toner and the charge-imparting material as described above. Accordingly, the term "base material" used herein is intended to cover materials in the form of particles inclusive of particles constituting toners and carrier particles. The term "carrying" has the same meaning as described above.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole figure in the drawing schematically illustrated a developing apparatus which is used to effect development by using a toner according to the present invention.

DETAILED DESCRIPTION OF THE INVENTION

The present invention is based on our discovery of the fact that the triazine type compound represented by the following formula is excellent as a positive charge controlling agent for a toner:

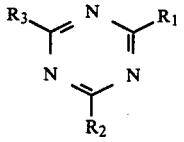

wherein $R_1$, $R_2$ and $R_3$ are respectively a hydrogen atom or an electron-donating group and may be the same or different. However, all of $R_1$, $R_2$ and $R_3$ cannot be hydrogen. Thus, the above class of triazine type compound is stable both thermally and against the elapse of time, little hygroscopic and colorless or substantially colorless. Therefore, when it is contained in a toner, the hue of a colorant in the toner is not deteriorated thereby, so that the toner can present a bright chromatic color. Based on these characteristics and the fact that it can appropriate control the charge of the toner, a triazine type compound can be a good positive charge controller.

Among the above class of triazine type compounds (I), those having an electron-donating group may have a particularly improved positive chargeability. Examples of the electron-donating group may include (A) amino group, substituted amino groups, (B) amido groups, and (C) alkyl groups and substituted alkyl groups.

(A) The substituted amino groups include monosubstituted amino groups and di-substituted amino groups, and examples of the substituents for the substituted amino groups may include alkyls ($C_1$–$C_{20}$), aryls ($C_6$–$C_{40}$) and aralkyls ($C_7$–$C_{40}$). The alkyls, aryls or aralkyls can further have a substituent. Specific examples of the substituted amino groups include the following: $-NHCH_3$, $-NHC_2H_5$, $-NHC_{12}H_{25}$,

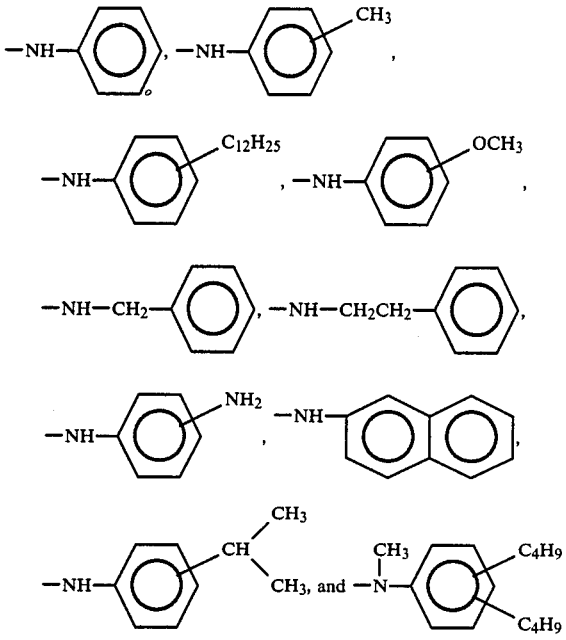

(B) The substituted amido groups include —NH-CO— alkyl ($C_1$–$C_{20}$) and —NHCO—aryl ($C_6$–$C_{20}$). Specific examples thereof include the following:

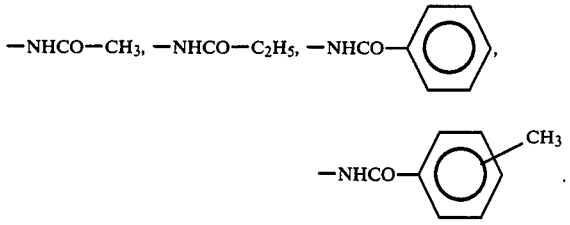

(C) The alkyl groups and substituted alkyl groups may have 1 to 20 carbon atoms and may be linear or branched groups inclusive of the following groups as examples:

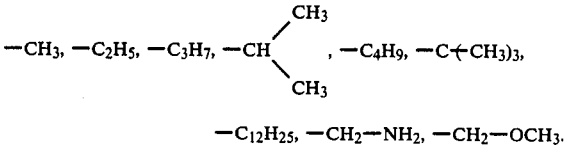

A particularly preferred class of triazine type compounds among those of the formula (I) may be represented by the following formula (II):

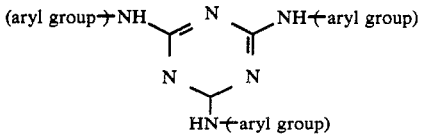

wherein the aryl group may be phenyl group, naphthyl group, or anthryl group, each of which can in turn have a substituent such as an alkyl ($C_1$-$C_6$), an alkoxy ($C_1$-$C_6$) or an amino group.

Specific and representative examples of the triazine type compound of the formula (I) include the Compound No. 1

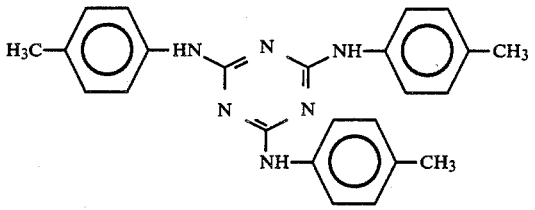

Compound No. 2

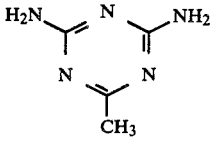

Compound No. 3

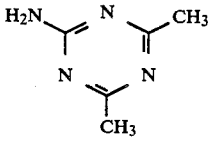

Compound No. 4

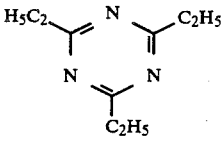

Compound No. 5

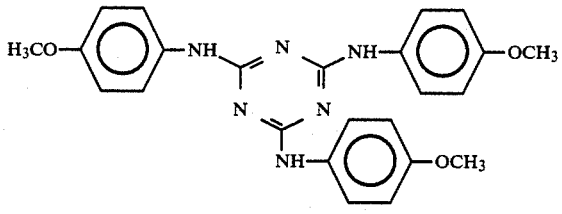

Compound No. 6

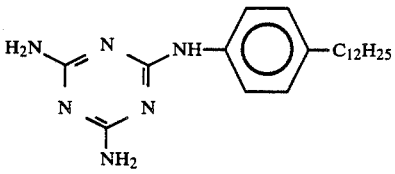

-continued

Compound No. 7

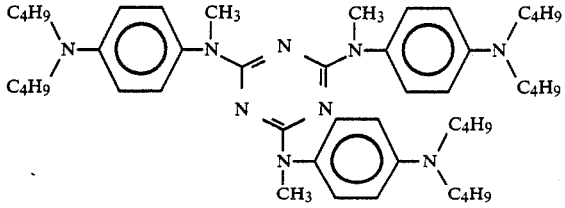

Compound No. 8

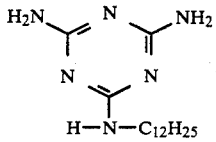

Compound No. 9

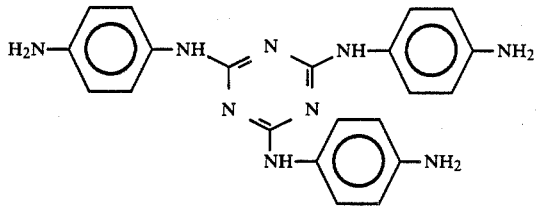

Various methods have been known for synthesis of triazine type compounds as described above, e.g., as reported by J. Am. Chem. Soc., 76, 632, (1954); J. Chem. Soc., 1947, 154; C.A., 43, 238 (1949); C.A., 45, 2513, (1951); J. Org. Chem., 17, 1162(1952); Chem. Ber., 87, 1965 (1954); Science, 121, 61 (1955); etc.

For example, the above mentioned Compound No. 1 is produced by a reaction between cyanuric chloride and p-toluidine.

The triazine type compound according to the invention may preferably be used in the form of particles having an average particle size of 10 to 0.01 μ, particularly 2 to 0.1 μ. In connection with the toner particles, the triazine type compound should preferably have a particle size of ½ or less, particularly 1/2.5 or less of the number-average particle size of the toner in order to provide a sharp distribution of charges to individual toner particles.

Herein, the particle sizes of the triazine type compound and the toner are number-average values based on values measured by using a Coulter Counter type II. The aperture size and the method for dispersion are appropriately selected according to a sample material. For example, a toner having a size of the order of 10 μ may be measured by using a dispersion having a sample concentration of 5 to 20% which has undergone about 5 minutes of ultrasonic dispersion and by using a 100 μ-aperture. A triazine type compound of several microns may be measured by using a dispersion having a sample concentration of 10 to 20% which has undergone about 15 minutes of ultrasonic dispersion and by using a 30 μ-aperture.

The triazine type compound as described may be used for preparation of triboelectrically chargeable composition according to the invention includsive of the toner and the charge-imparting material.

First of all, the above mentioned triazine type compound may be added to a toner (colored fine particles) comprising, as essential components, a binder resin and a colorant. More specifically, the triazine type compound may be added to a toner internally (incorporated inside the toner particles) or externally (mixed to adhere to the surface of the toner particles). For the purpose of the present invention, the internal addition is preferred.

In the case of the internal addition, the amount of the triazine type compound to be added may depend on several factors involved in a toner production process including kind of binder resin, optionally used additive and method of dispersion and are not determinned in a single way. However, the triazine type compound should preferably be used in a proportion of 0.1 to 20 wt. parts, more preferably 0.1 to 10 wt. parts, per 100 wt. parts of the binder resin.

In the case of the external addition, the triazine type compound should preferably be used in a proportion of 0.01 to 10 wt. parts, per 100 wt. parts of the binder resin.

A conventional charge controller may be used in combination with the charge controller compound according to the invention within an extent that it does not provide a harmful effect to the toner according to the invention.

The binder resin for the toner of the present invention may be composed of homopolymers of styrene and derivatives thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrileindene copolymer, styrene-maleic acid copolymer, styrene-maleic acid ester copolymer and styrene-dimethylaminoethyl methacrylate copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, chlorinated paraffin, paraffin wax, etc. These binder resins may be used either singly or as a mixture. Particularly excellent developing characteristics inclusive of a charge controlling characteristic and excellent durability can be obtained when the triazine type compound according to the invention is combined with a styrene-an acrylate copolymer, styrene-a methacrylate copolymer, a styrene-an acrylate-a maleic acid half-ester copolymer, or a styrene-a methacrylate-a maleic acid half-ester copolymer. The above-mentioned resins can be crosslinked by means of a crosslinking agent such as divinylbenzene.

The following binder resins may suitably be used singly or as a mixture, in particular, for providing a pressure-fixable toner:

Polyolefins such as low molecular-weight polyethylene, low molecular-weight polypropylene, polyethylene oxide and poly-4-fluoroethylene waxes such as polyethylene wax and paraffin wax; epoxy resin, polyester resin, styrene-butadiene copolymer (monomer ratio 5-30:95-70), olefin copolymers such as ethylene-acrylic acid copolymer, ethylene-acrylate copolymers, ethylene-methacrylic acid copolymer, ethylene methacrylate copolymers, ethylene-vinyl chloride copolymer, ethylene-vinyl acetate copolymers and ionomer resins); polyvinyl pyrrolidone, methyl vinyl ether-maleic anhydride copolymer, maleic acid-modified phenolic resin, and phenol-modified terpene resin.

The colorant to be used in the present invention may be one or a mixture of known dyes or pigments including Carbon Black, Lamp Black, Iron Black, Ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo and disazo dyes.

The toner according to the invention may be composed as a magnetic toner by incorporating therein a magnetic material. In this case, the magnetic material also functions as a colorant and the other colorant need not be used additionally. The magnetic material to be used for this purpose may be one or a mixture of: iron oxides such as magnetite, hematite and ferrite; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These magnetic materials may preferably be in the form of particles having an average particle size of the order of 0.1 to 2 microns and be used in the toner in an amount of about 20–200 wt. parts, particularly 40–150 wt. parts, per 100 wt. parts of the resin component. The magnetic material may preferably be treated with a hydrophobicity-imparting agent such as a silane coupling agent or a titanate coupling agent to improve the moisture resistance.

The toner according to the present invention may be mixed with carrier particles in a proportion of generally 1 part by weight of the toner with 1 to 200 parts by weight of the carrier particles to form a two-component developer. The carrier particles to be used for this purpose may be those known in the art including, for example, powder or particles of metals such as iron, nickel, aluminum and copper, alloys of these metals or metal compounds including oxides of these metals; and powder or particles of ceramics such as glass, SiC, $BaTiO_2$ and $SrTiO_2$. These particles may be coated with a resin, etc. Alaternatively, resin particles or resin particles containing a magnetic material may also be used. The carrier particles are generally mixed in a proportion of 1 to 100 wt. parts with 1 wt. part of the toner.

Another optional additive may be added externally or internally to the toner so that the toner will exhibit further better performances. Optional additives to be used as such include, for example, lubricants such as teflon and zinc stearate; abrasives such as cerium oxide and silicon carbide; flowability improvers such as colloidal silica and aluminum oxide; anti-caking agent; conductivity-imparting agents such as carbon black and tin oxide; or fixing aids or anti-offset agents such as low molecular-weight polyethylene.

These additives may preferably have the same triboelectric polarity as the toner or have almost no triboelectric chargeability in order to have the toner fully exhibit its effect.

The toner for developing electrostatic images according to the present invention may be produced by sufficiently mixing the positive charge controller compound according to the invention comprising a triazine type compound with a thermoplastic resin such as those enumerated hereinbefore, a pigment, dye or magnetic material as a colorant and an optional additive, etc., by means of a mixer such as a ball mill, etc.; then melting and kneading the mixture by hot kneading means such as hot rollers, kneader and extruder to disperse or dissolve the pigment or dye, the charge controller and optional additives, if any, in the melted resin; cooling and crushing the mixture; and subjecting the powder product to classification to form toner particles having an average particle size of 5 to 20 microns.

Alternatively, another method may be used such as a method of dispersing in a solution of the binder resin the other prescribed components and spray-drying the dispersion; or a method of mixing in a monomer providing the binder resin the other prescribed ingredients to form a suspension and polymerizing the suspension to obtain a toner.

Further, as briefly described hereinbefore, the toner according to the invention can also be produced by first producing a toner by omitting all or a part of the charge controller compound and then externally adding the charge controller compound.

The thus obtained toner according to the present invention may be used in known manners for developing electrostatic latent images obtained by electrophotography, electrostatic recording, electrostatic printing, etc., to visualize the latent images, whereby advantageous effects as described below are attained.

As described above, the toner according to the invention containing a triazine type compound as a positive charge controller have various excellent characteristics such that individual particles of the toner are caused to have a uniform triboelectric charge, and the amount of the charge is easily controlled and does not cause fluctuation or decrease. Thus, a very stable toner is obtained. Accordingly, undesirable phenomena are obviated such as development fog, toner scattering, and contamination of a photosensitive material for electrophotography and a copier. Further, the toner according to the present invention does not cause agglomeration, blocking or low-temperature fluidization. Thus, the toner can withstand a long period of storage, and the toner image is also excellent in abrasion resistance, fixation characteristic and adhesion characteristic.

These advantageous effects of the toner according to the invention are more fully exhibited when it is used in a repetitive transfer-type copying system wherein charging, exposure, developing and transfer operations are continuously and repetitively carried out. Further, as the charge controller does not provide little hindrance to color hue, so that the toner can provide an excellent chromatic color image when formulated as a toner for color electrophotography.

Hereinabove, the toner according to the present invention which is a typical and most preferred embodiment of the triboelectrically chargeable composition according to the present invention, has been fully described with respect to its ingredients, production process and use thereof. However, the triboelectrically chargeable composition according to the present invention may also be embodied as a charge-imparting material (or member) or toner movement-regulation material inclusive of magnetic particles, a carrier, a doctor blade, a toner-carrying member such as a sleeve by utilizing an excellent positive chargeability of the triazine type compound according to the invention. The charge-imparting material may be defined as a solid material which imparts or supplements a charge necessary for development to a toner while contacting the toner prior to or during the developing step.

In order to provide the charge-imparting material according to the invention, the triazine type compound according to the invention may be applied as a coating on or dispersed or incorporated in a base material which may be in the form of carrier particles or a fixed member such as a doctor blade or sleeve.

For this purpose, the charge controller compound, i.e., the triazine type compound according to the invention, may be used as such in the form of particles, or dispersed in a solvent or dispersant, or otherwise dispersed in a resin or a solution thereof. Powder of a ceramic material such as silica, aluminum oxide, cerium oxide or silicon carbide may be added to the above as a filler. Further, a conductivity imparting agent such as carbon black or tin oxide may be added to control the conductivity. In order to avoid the deposition or accumulation of spent toner on the sleeve or carrier particles as embodiments of the charge-imparting material, a releasing agent such as an aliphatic acid metal salt or polyvinylidene fluoride may be added.

As the resin for carrying or dispersing the charge controller compound according to the present invention may be those generally used including polystyrene, polyacrylic acid esters, polymethacrylic acid esters, polyacrylonitrile, rubber resins such as polyisoprene and polybutadiene, polyester, polyurethane, polyamide, epoxy resin, rosin, polycarbonate, phenolic resin, chlorinated paraffin, polyethylene, polypropylene, silicone resin, teflon, etc. Derivatives of these resins, copolymers of constituted monomers of these resins and mixtures of these resins may also be used.

The coating amount or content of the charge controller compound on the surface or in the surface layer of the charge-imparting material for development of electrostatic images which may be carrier particles, magnetic particles, a sleeve or a doctor blade, should be appropriately controlled and preferably be 0.01–10 $mg/cm^2$, particularly 0.01–2 $mg/cm^2$.

The carrier particles as an embodiment of the charge-imparting material, particularly the base material thereof, may be those as described above to be combined with the toner according to the invention.

The sleeve as another embodiment of the charge-imparting material may be formed of, for example, metals such as iron, aluminum, stainless steel and nickel or alloys of these metals. Further, the sleeve may be formed of a non-metallic substance such as ceramics and plastics.

In order to produce the charge-imparting material, for example, the carrier particles may be obtained by dipping the base or core particles in a dispersion of the charge controller compound in a resin solution or dispersion or applying the dispersion to the base particles, and thereafter drying the coated particles, as desired.

The sleeve may be obtained by applying the dispersion of the charge controller compound as described above by dipping, spraying, brush coating.

Alternatively, the charge controller compound according to the invention may be dispersed in a shapable resin to form carrier particles, a sleeve or a doctor blade.

The present invention will be more specifically explained with reference to examples, while it is to be understood that the present invention is not limited to the specifically described examples. In the examples, "parts" used for describing formulations are all by weight.

EXAMPLE 1

| | |
|---|---|
| Styrene/butyl acrylate copolymer (Monomer weight ratio = 80:20, Weight average molecular weight Mw = about 300,000) | 100 parts |
| Carbon black (Mitsubishi #44) | 10 parts |
| Low-molecular weight polyethylene wax | 2 parts |
| Triazine type compound (Compound No. 1 as described before; Number-average particle size = about 3μ) | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain positively chargeable fine toner powder with particle sizes of 5–20 μ and a number-average particle size of about 9 μ. Then, 5 parts of the fine toner powder was mixed with 100 parts of iron powder carrier having an average particle size of 50–80 μ to prepare a developer. The triboelectric charge of the toner in the developer was measured to be +11.5 μC/g according to an ordinary blow-off method.

Then, a negative electrostatic image was formed on an OPC (organic photoconductor) photosensitive member by a known electrophotographic technique and developed with the above prepared developer containing a positively charged toner by the magnetic brush method to form a toner image, which was electrostatically transferred to plain paper and fixed by means of hot pressing rollers. The thus obtained image had a sufficiently high density of 1.34 and was free of fog and toner scattering around the image, thus found to be a good image with a high resolution. The above developer was used in a successive copying test for successively forming transferred images so as to check the durability, whereby transferred images were not at all inferior to those obtained at the initial stage.

Further, during the successive copying test, the above-mentioned phenomenon of "filming" on the photosensitive member was not observed, nor was observed any problem during the cleaning step. No trouble was encountered in the fixing step either. After the termination of the successive copying test, the fixing device was observed, whereas no flaw or damage was observed on the rollers nor was observed almost any staining with offset toner thus being practically of no problem.

Further, when the environmental conditions were changed to 35° C.- 85 %, clear images were obtained without fog or scattering, and the image density of 1.27 which was substantially equal to that obtained under the normal temperature-normal humidity was obtained. The image quality after the successive copying did not substantially change.

Then, when transferred images were obtained under low temperature-low humidity conditions of 15° C. 10 %, excellent images could be obtained with a high image density of 1.30 and solid black portions could be very smoothly developed without scattering or drop-off in the central parts. Under these environmental conditions, a successive copying test was conducted continuously and intermittently, whereas the fluctuation in density was within ±0.2 and practically of no problem.

COMPARATIVE EXAMPLE 1

A developer was prepared in the same manner as in Example 1 except that 2 parts of a nigrosine dye (Nigrosine EX, produced by Orient Kagaku Kogyo K.K.) was used in place of the 2 parts of Compound No. 1, and the developer was subjected to developing, transferring and fixing. At normal temperature and normal humidity, fog occurred little, but the image density was as low as 1.06 with scattering of line images and conspicuous coarsening at the solid black portions. During the successive copying test, the toner material formed a film in the form of thin streaks on the photosensitive member at a time around 10,000 sheets of copying. This is a so-called "filming" phenomenon which is considered to have occurred because the charge controller changed the lubrication characteristic of the toner. Further, during the successive copying, the fixed image surface of recording paper was liable to be caught into fixing rollers and had a difficulty in pealability from the rollers.

When images were obtained under the conditions of 35° C. and 85 %, the image density was lowered to 0.88 with increase of fog, scattering of the toner and coarsening of the image. The transfer efficiency was also lowered.

When the images were obtained under the conditions of 10° C. and 10 %RH, the image density was as low as 0.91, with excessive scattering, fog and coarsening, and transfer drop-off was markedly observed.

EXAMPLE 2

A developer was prepared in the same manner as in Example 1 except that 3 parts of Compound No. 2 as described before was used in place of 2 parts of Compound No. 1, and the obtained developer was similarly subjected to developing, transferring and fixing to obtain images, whereby the results as shown in Tables 1 and 2 were obtained.

EXAMPLE 3

A developer was prepared in the same manner as in Example 1 except that 2 parts of Compound No. 3 was used in place of 2 parts of Compound No. 1, and the obtained developer was similarly subjected to developing, transferring and fixing to obtain images, whereby results as shown in Tables 1 and 2 were obtained.

EXAMPLE 4

A developer was prepared in the same manner as in Example 1 except that 2 parts of Compound No. 4 was used in place of 2 parts of Compound No. 1, and the obtained developer was similarly subjected to developing, transferring and fixing to obtain images.

The results are also shown in Tables 1 and 2.

EXAMPLE 5

| | |
|---|---|
| Styrene/butyl acrylate copolymer (copolymerization weight ratio = 80:20, weight average molecular weight Mw = about 300,000) | 100 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with sizes of 5–20 μand a number-average size of about 10 μ. Then, 0.4 part of hydrophobic positive colloidal silica treated with amino-modified silicone oil (produced by Nihon Aerosil K.K.) was admixed with 100 parts of the fine powder as obtained above to prepare a one-component magnetic toner. The triboelectric charge of the toner was measured according to the blow-off method.

The toner was applied to a commercially available copier (Trade name: NP-150Z, mfd. by Canon K.K.) for imaging, whereby the results as shown in Tables 1 and 2 were obtained.

EXAMPLE 6

A developer was prepared in the same manner as in Example 5 except that 3 parts of Compound No. 2 was used in place of 2 parts of Compound No. 1, and the obtained developer was similarly subjected to developing, transferring and fixing to obtain images.

The results are also shown in Tables 1 and 2.

EXAMPLE 7

A developer was prepared in the same manner as in Example 5 except that 2 parts of Compound No. 3 was used in place of 2 parts of Compound No. 1, and the obtained developer was similarly subjected to developing, transferring and fixing to obtain images.

The results are also shown in Tables 1 and 2.

COMPARATIVE EXAMPLE 2

A developer was prepared in the same manner as in Example 5 except that 2 parts of dimethylbenzyl hexadecylammonium chloride was used in place of 2 parts of Compound No. 1 and the developer was subjected to developing, transferring and fixing. At normal temperature and normal humidity, fog occurred little, but the image density was as low as 0.81 with scattering of line images and conspicuous coarsening at the solid black portions.

When images were obtained under the conditions of 35° C. and 85 %, the image density was lowered to 0.72 with increase of fog, scattering of the toner and coarsening of the image, proving to be practically unacceptable. The transfer efficiency was also low.

When the images were obtained under the conditions of 10° C. and 10 %RH, the image density was as low as 0.73, with excessive scattering, fog and coarsening, and transfer drop-off was markedly observed.

EXAMPLE 8

| | |
|---|---|
| Styrene/butyl acrylate copolymer (copolymerization monomer weight ratio = 80:20; weight average molecular weight Mw = about 300,000) | 100 parts |
| Copper phthalocyanine blue pigment | 5 parts |
| Low-molecular weight polypropylene wax | 2 parts |
| Compound No. 1 (number-average particle size = about 2μ) | 2 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with particle sizes of 5–20 μ (number-average particle size =about 10 μ). The triboelectric charge of the toner was measured by the blow-off method.

Then, 100 parts of the fine powder was mixed with 50 parts of carrier iron powder having particle sizes of 50–80 μ to prepare a developer.

The developer was used in a developing apparatus as shown in the accompanying drawing to effect imaging. More specifically, in the apparatus, a container 1 was provided with a cylindrical toner-carrying member 2 so that the toner-carrying member (sleeve) 2 almost blocked up the lower opening of the container 1. The toner-carrying member was made of a stainless steel cylinder with a roughened surface and rotated at a peripheral speed of 66 mm/sec. in the direction of arrow a. On the other hand, at exit provide at the downstream end of the container 1 in the rotational direction of the sleeve 2, an iron blade 3 was disposed with its tip 200 μm away from the sleeve surface. Inside the sleeve 2 was disposed a fixed magnet 4 with its N pole as a major magnetic pole thereof placed at a position forming an angle θ of 30° C. between lines connecting the N pole and the tip of the blade 3, respectively, with the center of the sleeve 2. Under these conditions, as the sleeve 2 rotates, a magnetic brush 5 is formed with carrier iron powder contained in a developer in the container 1, and this magnetic brush 5 circulated along the surface of the sleeve at the lower part of the container 1 while taking therein a toner 6 distributed preferentially above the magnetic brush 5 and supplying the toner to the surface of the sleeve 2, thereby to form a thin layer 16 of the toner on the surface of the sleeve 2 at a position having passed by the blade 3.

In this Example, the thus formed thin layer of the toner of about 80 μm in thickness was used to develop a negative electrostatic image with −600 V at a bright portion and −1500 V at a dark portion formed on a photosensitive drum 7 which was disposed opposite to and with a spring of about 300 μm at the developing zone (the closest portion) from the sleeve 2 and rotated in the direction of arrow b at a peripheral speed of 60 mm/sec. At this time, an alternating bias voltage with a peak-to-peak value of 1.8 KV and a center value of −300 V and a frequency of 800 Hz was applied between the sleeve 2 and the photosensitive drum 7.

As a result of imaging in the manner as described above, a good image showing a clear blue color was obtained. Substantially no change in image density was observed until the tone/carrier ratio reached 10 parts/50 parts after 1500 sheets of imaging.

The results of evaluation in the above Examples and Comparative Examples under the sets of conditions of the normal temperature-normal humidity (25° C.-60 %RH), the high temperature-high humidity (35° C.-85 %RH) and the low temperature-low humidity (15° C.-10 %RH) are inclusively shown in the following Tables 1 and 2.

TABLE 1

| | Normal temperature, Normal humidity | | | | | | |
|---|---|---|---|---|---|---|---|
| | Triboelectric charge at initial stage (μC/g) | Image density | Fog | Scat-tering | Reproduci-bility of thin lines | On successive copying Filming | Fixation |
| Example | | | | | | | |
| 1 | +11.5 | 1.34 | o | o | o | o | o |
| 2 | +10.8 | 1.22 | o | o | o | o | o |
| 3 | +9.5 | 1.21 | o | o | o | o | o |
| 4 | +8.6 | 1.20 | o | o | o | o | o |
| 5 | +10.4 | 1.31 | o | o | o | o | o |
| 6 | +9.4 | 1.19 | o | o | o | o | o |
| 7 | +8.3 | 1.17 | o | o | o | o | o |
| 8 | +11.7 | 1.28 | o | o | o | o | o |
| Comparative Example | | | | | | | |
| 1 | +6.3 | 1.06 | Δ | Δ | Δ | Δ | Δ |
| 2 | +2.3 | 0.81 | x | x | Δ | Δ | Δ |

In the above table and tables appearing hereinafter, the symbols denote the following: o: Good oΔ: Rather good, Δ: Rather bad x: Bad

TABLE 2

| | 35° C., 85% | | | 15° C.,10% | | |
|---|---|---|---|---|---|---|
| | Image density | Fog | Transfer efficiency (%) | Image density | Fog | Transfer efficiency (%) |
| Example | | | | | | |
| 1 | 1.27 | o | 80–90 | 1.30 | o | 80–90 |
| 2 | 1.19 | o | " | 1.25 | o | " |
| 3 | 1.17 | o | " | 1.23 | o | " |
| 4 | 1.18 | o | " | 1.17 | o | " |
| 5 | 1.27 | o | " | 1.33 | o | " |
| 6 | 1.11 | oΔ | " | 1.21 | o | " |
| 7 | 1.12 | o | " | 1.15 | o | " |
| 8 | 1.20 | o | " | 1.30 | o | " |
| Comp. Ex. | | | | | | |
| 1 | 0.88 | Δ | 60–70 | 0.91 | Δ | 60–70 |
| 2 | 0.72 | x | " | 0.73 | Δ | " |

EXAMPLE 9

A fine powdery toner having a number-average particle size of about 9 μ was prepared in the same manner as in Example 1 except that 2 parts of Compound No. 5 (number-average particle size=about 3 μ) was used in place of 2 parts of Compound No. 1, and the obtained toner was similarly subjected to developing, transferring, and fixing. As a result, good fixed toner images of an image density of 1.35 were obtained.

EXAMPLE 10

A fine powdery toner having a number-average particle size of about 2 μ was prepared in the same manner as in Example 1 except that 2 parts of Compound No. 9 (number-average particle size=about 8 μ) was used in place of 2 parts of Compound No. 1, and the obtained toner was similarly subjected to developing, transferring, and fixing. As a result, good fixed toner images of an image density of 1.36 were obtained.

EXAMPLE 11

In 1 liter of methyl ethyl ketone (MEK) was dissolved 100 g of Compound No. 1 and further mixed with 1 kg of iron powder carrier (particle size: 250–400 mesh) under stirring for about 30 minutes in a ball mill. The mixture, after removal of the solvent, was dried and crushed to disintegrate a slight agglomeration thereby to obtain a treated iron powder carrier.

For the purpose of comparison with the above carrier, a comparative carrier was prepared in the above manner except that the Compound No. 1 was not used.

Separately, the following ingredients were kneaded, crushed and classified to prepare a toner containing no charge controller compound and having particle sizes of 1 to 30 μ.

| | |
|---|---|
| Styrene resin (trade name: D-125, mfd. by Shell Chemical Co.) | 100 parts |
| Carbon black (trade name: Raven 3500, mfd. by Cabot Co.) | 6 parts |

This toner was mixed with the above prepared carriers respectively in a weight ratio of 10:100 to form developers.

The triboelectric charges of these developers were measured by the blow-off method and the following results were obtained:

| | |
|---|---|
| Example 11 | −11 μC/g |
| Comparison | −2 μC/g. |

These developers were used for imaging by means of a copying machine (NP-5000, mfd. by Canon K.K.). As a result, the developer obtained by using the carrier of Example 11 provided toner images at a density of 1.2 with good reproducibility of thin lines and good gradation and without fog. In contrast thereto, only images with a low density of 0.9 could be obtained with the comparison developer.

EXAMPLE 12

In 1 liter of xylene was dissolved 100 g of polymethyl methacrylate resin and further mixed with 50 g of Compound No. 2. The solution was fully mixed with 1 kg of iron powder carrier as used in Example 11. The mixture, after removal of the solvent, was dried and crushed to disintegrate a slight agglomeration thereby to obtain a treated iron powder carrier improved in charge-imparting ability.

The thus treated iron powder carrier in an amount of 100 parts was mixed with 10 parts of the toner used in Example 11 to prepare a developer. The triboelectric charge of the toner in the developer was measured to be −10 μC/g. The developer was used for imaging, whereby good images were obtained with good reproducibility of thin lines and good gradation and without fog.

EXAMPLE 13

In 1 liter of xylene was dissolved 150 g of polymethyl methacrylate resin and further mixed with 50 g of Compound No. 3. Into the solution thus obtained was dipped a developing sleeve (made of stainless steel) for a copier (NP-400RE Canon K.K.), and the solvent was removed to form a coating film at a rate of 0.1 to 0.6 mg/cm$^2$.

For the purpose of comparison, a coated sleeve for comparison was prepared in the same manner except that the Compound No. 3 was not added.

The thus obtained coated sleeves were respectively affixed to the developing apparatus for the copier and were used for a test explained hereinafter.

Separately, the following ingredients were kneaded, crushed and classified to prepare a toner having particle sizes of 1 to 30 $\mu$.

| | |
|---|---|
| Styrene/butyl methacrylate copolymer (Mw = 150,000) | 100 parts |
| Low-molecular weight polyethylene (Trade name: PE-130, mfd. by Hoechst A.G.) | 4 parts |
| Magnetic powder (Trade name: BL-200, mfd. by Titan Kogyo K.K.) | 60 parts |

The thus prepared toner having particle sizes in the range of 1 to 30 $\mu$ was subjected to a successive imaging test by means of the above-mentioned developing apparatus provided with a coated sleeve, whereby clear blue images were obtained with good reproducibility of thin lines and gradation and without fog when the coated sleeve of the present invention was used.

In contrast thereto, when the coated sleeve for comparison was used, images with much fog were obtained.

The surface potentials of the toners on the coated sleeves were measured at −25 V for the sleeve of the present invention and at −7 V for the sleeve for comparison. Thus, the sleeve of the present invention was found to provide a sufficiently negatively charged toner.

EXAMPLE 14

In 1 liter of xylene was dissolved 80 g of polycarbonate resin and further mixed with 20 g of Compound No. 4. Into the solution thus obtained was dipped a developing sleeve (made of aluminum) for a blue cartridge of a copier (PC-20, Canon K.K.), and the solvent was removed to form a coating film at a rate of 0.1 to 0.5 mg/cm$^2$. The thus coated sleeve was affixed to the developing apparatus for the copier and was used for a test explained hereinafter.

Separately, the following ingredients were kneaded, crushed and classified to prepare a toner having particle sizes of 1 to 30 $\mu$.

| | |
|---|---|
| Styrene/butyl methacrylate copolymer (Mw = 150,000) | 100 parts |
| Low-molecular weight polyethylene (Trade name: PE-130, mfd. by Hoechst A.G.) | 4 parts |
| Blue colorant (Phthalocyanine pigment) | 6 parts |

The thus prepared toner having particle sizes in the range of 1 to 30 $\mu$ was subjected to a successive imaging test by means of the above-mentioned developing apparatus provided with the coated sleeve and adjusted to effect reversal development by remodelling the PC-20 copier. As a result, clear blue images were obtained with good reproducibility of thin lines and gradation until the toner was consumed. The surface potential of the toner on the sleeve was measured at −24 V, and the toner was negatively charged.

EXAMPLES 15–18

Examples 15–18 were carried out by repeating the procedures of Examples 11–14, respectively, and by using the following triazine type compounds in place of those used in Examples 11–14, respectively.

| | |
|---|---|
| Example 15: | Compound No. 5 |
| Example 16: | Compound No. 6 |
| Example 17: | Compound No. 7 |
| Example 18: | Compound No. 8 |

Good results were obtained thereby, and the following triboelectric charges or surface potentials were obtained correspondingly.

| | |
|---|---|
| Example 15: | −19 $\mu$C/g |
| Example 16: | −12 $\mu$C/g |
| Example 17: | −23 V |
| Example 18: | −28 V. |

What is claimed is:

1. A positively chargeable toner for developing electrostatic latent images, comprising: a binder resin, a colorant, and a triazine type compound represented by the following formula (I):

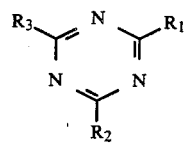

wherein $R_1$, $R_2$ and $R_3$ are the same or different groups selected from hydrogen atom and electron-donating groups which are more electron-donative than hydrogen atom, all of $R_1$, $R_2$ and $R_3$ not being hydrogen atom.

2. A toner according to claim 1, wherein said electron-donating group is amino group, a monosubstituted amino group, a di-substituted amino group, an amido group, an alkyl group, or an alkyl group having a substituent.

3. A toner according to claim 2, wherein the monosubstituted amino group or di-substituted amino group has an alkyl group having 1–20 carbon atoms, an aryl group having 6–40 carbon atoms or an aralkyl group having 7–40 carbon atoms.

4. A toner according to claim 3, wherein the monosubstituted amino group is —NHCH$_3$, —NHC$_2$H$_5$,

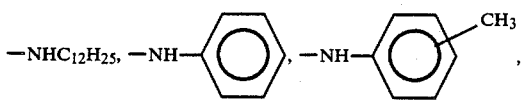

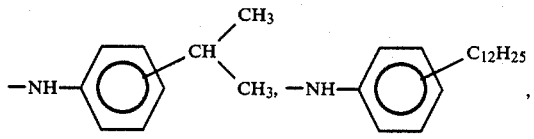

-continued

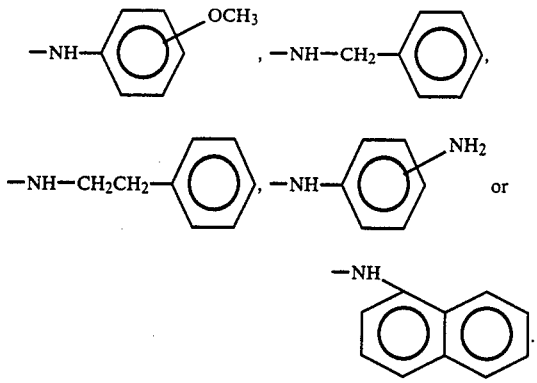

5. A toner according to claim 2, wherein said amido group is represented by:

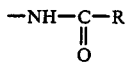

wherein R is an alkyl group having 1–20 carbon atoms or an aryl group having 6–20 carbon atoms.

6. A toner according to claim 5, wherein said amido group is

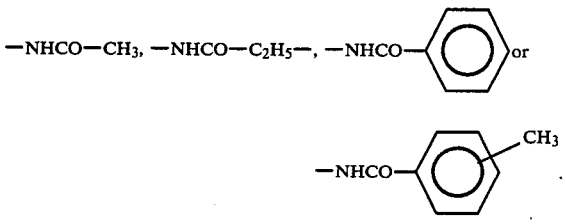

7. A toner according to claim 2, wherein said alkyl group is a linear or branched alkyl group having 1–20 carbon atoms.

8. A toner according to claim 7, wherein said alkyl group has a substitutent of an amino or methoxy group.

9. A toner according to claim 1, wherein said triazine type compound is a compound represented by the following formula (II):

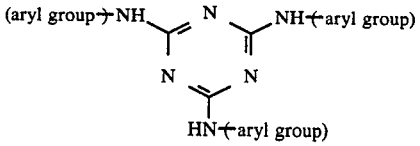

wherein the aryl group denotes a phenyl group, a naphthyl group or an anthryl group.

10. A toner according to claim 1, which comprises 0.1 to 20 parts by weight of the triazine type compound with respect to 100 parts by weight of the binder resin.

11. A toner according to claim 1, wherein the triazine type compound has a number-average particle size of 0.01 to 10 μ which is ½ or less of the number-average particle size of the toner.

12. A toner according to claim 1, wherein the binder resin comprises a styrene copolymer.

13. A toner according to claim 1, wherein the binder resin comprises a styrene-an acrylic acid ester copolymer, a styrene-a methacrylic acid ester copolymer, a styrene-an acrylic ester-a maleic acid half ester copolymer, or a styrene-a methacrylic acid ester-a maleic acid half ester copolymer.

14. A charge-imparting material, comprising: a positively chargeable triazine type compound and a base material carrying the triazine type compound, the triazine type compound being represented by the following formula (I):

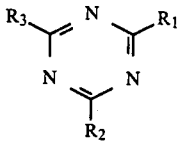

wherein $R_1$, $R_2$ and $R_3$ are the same or different groups selected from hydrogen atom and electron-donating groups which are more electron-donative than hydrogen atom, all of $R_1$, $R_2$ and $R_3$ not being hydrogen atom.

15. A charge-imparting material according to claim 14, wherein said base material comprises magnetic particles, carrier particles, a sleeve or a doctor blade.

16. A triboelectrically chargeable composition, comprising: a positively chargeable triazine type compound and a base material carrying the triazine type compound, the triazine type compound being represented by the following formula (I):

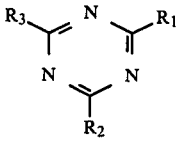

wherein $R_1$, $R_2$ and $R_3$ are the same or different groups selected from hydrogen atom and electron-donating groups which are more electron-donative than hydrogen atom, all of $R_1$, $R_2$ and $R_3$ not being hydrogen atom.

* * * * *